United States Patent [19]

Lazar

[11] Patent Number: 4,979,251

[45] Date of Patent: Dec. 25, 1990

[54] BED SHEET MOUNTING SYSTEM

[76] Inventor: Norma Lazar, 1838 S. Camberley La., Hacienda Heights, Calif. 91745

[21] Appl. No.: 351,823

[22] Filed: May 15, 1989

[51] Int. Cl.[5] ..... A47G 9/02

[52] U.S. Cl. ..... 5/496; 5/500/460

[58] Field of Search ..... 5/495–502, 5/460

[56] References Cited

U.S. PATENT DOCUMENTS

| | | | |
|---|---|---|---|
| 644,665 | 3/1900 | Daschbach | 5/493 |
| 710,477 | 10/1992 | Littell | 5/493 |
| 2,763,875 | 9/1956 | Piontkowski | 5/493 |
| 3,066,321 | 12/1962 | Kintner | 5/320 |
| 3,066,323 | 12/1962 | Kintner | 5/334 |
| 3,179,958 | 4/1965 | Carris | 5/496 |
| 3,413,665 | 12/1968 | Amet | 5/334 |
| 3,654,059 | 4/1972 | Zisblatt | 5/496 |
| 3,855,655 | 12/1974 | Propst | 5/496 |
| 3,879,777 | 4/1975 | Walker | 5/500 |
| 3,965,504 | 6/1976 | Ainsworth | 5/334 |
| 4,040,133 | 8/1977 | Golreath | 5/496 |
| 4,045,832 | 9/1977 | DiForti et al. | 5/334 |
| 4,241,466 | 12/1980 | Mendyk | 5/497 |
| 4,301,561 | 11/1981 | McLeod | 5/496 |
| 4,413,368 | 11/1983 | Schuetze | 5/494 |
| 4,470,857 | 9/1984 | Casalou | 5/498 |
| 4,488,323 | 12/1984 | Colburn | 5/496 |
| 4,549,323 | 10/1985 | Brockhaus | 5/455 |
| 4,587,683 | 5/1986 | Gardiner | 5/497 |
| 4,807,316 | 2/1989 | Whipple | 5/493 |
| 4,916,766 | 4/1990 | Grandy | 5/496 |

FOREIGN PATENT DOCUMENTS

| | | | |
|---|---|---|---|
| 1445600 | of 0000 | France | 5/496 |
| 9147 | 2/1898 | United Kingdom | 5/493 |

*Primary Examiner*—Michael F. Trettel
*Assistant Examiner*—F. Saether
*Attorney, Agent, or Firm*—Christie, Parker & Hale

[57] ABSTRACT

A bedding system which comprises a rectangular mattress, a top sheet and a bottom sheet. The top and bottom sheets are releasibly connectable to the mattress via cooperating areas of hook and loop material respectively carried by the mattress and the sheets. The bottom sheet connects along its sides to the mattress sides and does not overlay a foot end of the mattress. The top sheet connects to the foot end of the mattress. The top and bottom surfaces of the mattress couple to a mattress pad and a blanket via additional hook and loop fasteners. A dust ruffle can be connected in a similar manner to the sides and a foot end of a box spring or other mattress support.

12 Claims, 5 Drawing Sheets

BED SHEET MOUNTING SYSTEM

FIELD OF THE INVENTION

The present invention relates generally to bedding and more particularly to a means for retaining sheets, blankets, mattress pads and dust ruffles to beds.

BACKGROUND OF THE INVENTION

In maintaining a bed in a clean, smooth and comfortable condition for sleeping, it is necessary to make the bed daily and to change or replace the bedding sheets periodically. In the case of bedding replacement, and often when making a bed, the bedding must be completely removed and replaced in order for the bed to be properly remade. The sheets are first placed on the bed and then tucked under the mattress, occasionally requiring the lifting of the edges and ends of the mattress. Making beds in this manner is time consuming and can cause considerable back strain.

The use of contour or fitted sheets does not lead to a solution of these problems. The fitting of one or more such sheets to a mattress still requires lifting the mattress at the corners, thus not avoiding back strain. Contour sheets are more time consuming and difficult to use than standard sheets when a bed is located adjacent to a wall as the corners of the mattress are then not easily accessible. Contour sheets are more difficult and expensive to fabricate than standard flat sheets because contour sheets can have mitered corners and usually include an elastic strip around the bottom of each corner of the sheet.

It is also known to use hook and loop material, commonly sold under the trademark VELCRO, to secure a sheet to a mattress. A problem associated with existing hook and loop fasteners in known bedding systems is that the fastening material is often placed near the corners of the sheets so that a cup or pocket will be formed after the sheet is fastened in place over the mattress. The fit of the sheet must be tight in order to secure the sheet by its corners to the mattress. The combination of shear, torque and tensile forces exerted on the corners of such a fitted sheet during normal use of the bed can cause the hook and loop strip fasteners to work loose.

Other bedding systems using hook and loop fasteners place fasteneing material strips near the top or the bottom of the sides of the mattress. The sheets in these systems have mating fastening strips placed to exactly fit the location of the mattress strips. A problem with these systems is that no provision is made for turning of the mattress end for end or top for bottom. It is well known that mattresses last longer if rotated and turned on a regular basis. After turning a mattress of one of these known systems, the fastening strips on the mattress and the sheets no longer align properly, thus rendering the system inoperable.

As demonstrated by the foregoing background matters, there exists a substantial need for an improved bedding system overcoming the problems and drawbacks discussed above. A system is needed which allows a bed to be quickly made without the need to stoop and lift the mattress, and which allows the mattress to be turned end for end and top to bottom without affecting the operation of the system.

SUMMARY OF THE INVENTION

The present invention provides a new and advantageous bedding system which enables top and bottom sheets to be secured to a mattress without introducing the drawbacks associated with the prior art discussed above. Additionally, the system affords easy connection of blankets, mattress pads and dust ruffles to mattresses.

In its presently preferred embodiment, the invention is a bedding system comprising a rectangular mattress, a bottom sheet and a top sheet. The bottom and top sheets are releasibly connectable to the mattress via the agency of ccoperating areas of hook and loop material respectively carried by the mattress and the sheets. The mattress, having opposite major surfaces bounded by side and end surfaces normal to the major surfaces, has a plurality of pieces of hook material secured to each of its side and end surfaces, aligned substantially between the mattress' major surfaces. The pieces of hook material secured to the side surfaces of the mattress are disposed in essentially identical first predetermined patterns symmetrical about the midlength of each side surface, and the pieces of hook material secured to the end surfaces are disposed in essentially identical second predetermined patterns symmetrical about the midlength of each end surface, whereby the patterns are essentially the same relative to the mattress' top surface and foot end regardless of which major surface is the top surface and which end surface is the foot end surface. The bottom sheet is a simple rectangular sheet of fabric having obverse and reverse surfaces, opposite side edges, and opposite head and foot end edges. The distance between the side edges is a selected amount greater than the distance across the mattress' major surface. The bottom sheet includes a plurality of pieces of loop material secured to the bottom sheet reverse surface proximate the side edges and disposed in each instance in a third predetermined pattern corresponding to the first predetermined pattern of hook material pieces disposed on the side surfaces of the mattress. The center of each third pattern along each side edge of the bottom sheet is spaced from the foot edge of that sheet a distance substantially equal to one-half the distance between the mattress end surfaces. The top sheet is a simple rectangular sheet of fabric having obverse and reverse surfaces, opposite side edges, and opposite head and foot end edges. The top sheet includes a plurality of pieces of loop material secured to the top sheet obverse surface proximate to the foot edge and disposed in a fourth predetermined pattern corresponding to the second predetermined pattern of hook material on the end surfaces of the mattress. The center of the fourth pattern is disposed substantially at the midlength of the distance between the top sheet side edges. The bottom sheet is engagable with the mattress by its placement on the mattress such that it hangs evenly over the sides of the mattress with the loop material on the sheet aligned with the hook material on the mattress. The loop material on the sheet is then pressed against the hook material on the mattress securing the sheet to the mattress. The top sheet is engagable with the mattress by its placement on the mattress over the bottom sheet such that it hangs evenly over the sides and the foot end of the mattress with the loop material on the foot end of the sheet aligned with the hook material on the foot end of the mattress. The loop material on the sheet is then pressed against the hook material on the mattress securing the sheet to the mattress.

The bedding system can also include a mattress pad and a blanket. Pieces of loop material are secured to the pad's reverse surface proximate to each of its corners, disposed in a fifth predetermined pattern. In each instance the mattress has pieces of hook material secured on its two major surfaces proximate the corners of the surfaces in a sixth predetermined pattern corresponding to the fifth predetermined pattern of the loop material pieces on the mattress pad. Pieces of loop material are secured to the blanket's reverse surface proximate to each corner of the foot edge thereof in a seventh predetermined pattern related to the sixth predetermined pattern of the hook material pieces on the mattress. The mattress pad is engagable with the mattress by placement on the mattress such that it is centered on the mattress with the loop material on the corners of the mattress pad facing towards and aligned with the hook material on the corners of the mattress. The loop material on the mattress pad is then pressed against the hook material on the mattress securing the mattress pad to the mattress. The blanket is engagable with the mattress by its placement on the sheets and tucking the foot end of the blanket under the mattress such that the loop material on the corners of the blanket are facing towards and engaged with the hook material on the major underside surface of the mattress near the foot end of the mattress.

Further, or as an alternate to the sheets, blanket and mattress pad, the system can include a dust ruffle attachable to a box spring. A plurality of pieces of hook material can be secured to each of the box spring's side and end surfaces disposed in a further predetermined pattern adjacent the upper major surface of the box spring. The dust ruffle has an effective length approximately equal to the combined length of the side and one end surface of the box spring. The dust ruffle includes a plurality of pieces of loop material secured to its inner side disposed according to the further predetermined pattern.

BRIEF DESCRIPTION OF THE DRAWINGS

The above-mentioned and other features of this invention are more fully set forth in the following description of the presently preferred embodiment of the invention, which description is presented with reference to the drawings, wherein.

DETAILED DESCRIPTION

Figure 1:
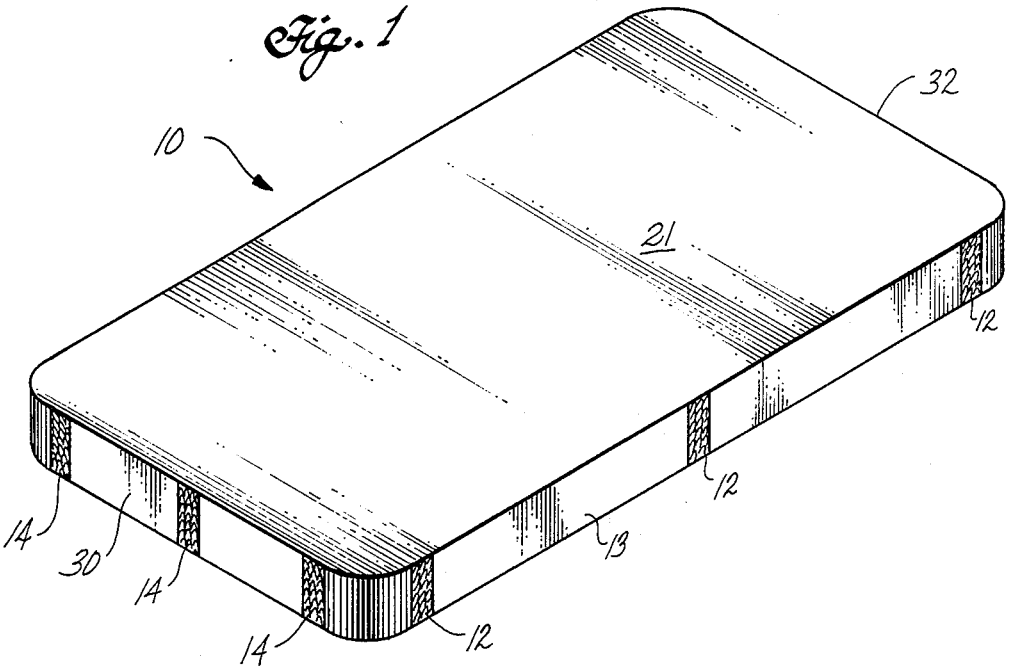
FIG. 1 is a perspective view of a mattress showing lower and upper sheet attachment points of the presently preferred embodiment of the invention.

The present invention is a bedding system which provides an improved way to mount the top and bottom bed sheets, as a pair, to a mattress. Both the top and bottom sheets are rectangular and flat, that is, they do not have fitted, mitered or shaped corners. The sheets are releasibly secured to the mattress by use of a cooperating first and second moieties of suitable releasable fastening or connecting arrangements. In the presently preferred embodiment of this invention, the several components of which are shown in the accompanying drawings, those moieties are pieces of cooperating hook and loop material which form respective parts of a releasable fastener commonly sold under the trademark VELCRO.

The mattress 10, as shown in FIG. can be a standard commercially available mattress to which pieces of hook material 12 are attached, as by bonding or sewing (see, e.g., FIGS. 9 and 10), along the long sides 13 of the mattress 10. The pieces of hook material 12 may be of any suitable shape and placed in any pattern which is vertically symmetrical about the centerline of the sides of the mattress and horizontally symmetrical between the ends of the sides of the mattress. The pattern of hook material areas along the sides 13 of the mattress is a first predetermined pattern.

Additional pieces of hook material 14, are attached, as by bonding or sewing, along the foot end 30 and the head end 32 of the mattress 10. These pieces of hook material 14 may be of any suitable shape and placed in any pattern which is vertically symmetrical about the centerline of the end surfaces of the mattress 10 and horizontally symmetrical between the ends of the end surfaces of the mattress 10. The pattern of pieces of such material on the ends of the mattress 10 is in a second predetermined pattern.

Pieces 12 and 14 of hook material preferably are of the same size and shape, thcugh they need not be so as they normally will sustain different levels of load in use. Preferably they are uniformly wide strips of hook material cut into pieces of sufficient length to encompass substantially the full width of the mattress side and end surfaces to which they are attached with their long dimensions preferably extending between the mattress major surfaces. Hock material pieces 12 and 14 can be attached to mattress 10 as a step in the manufacture of the mattress. Alternatively, as described more fully below, the hook material pieces can be attached to an existing mattress by a user or owner of the mattress. In the latter instance, the pieces of hook material can be provided, perhaps with cooperating pieces of pile or loop material, as elements of a kit (a retrofit kit) for adapting an existing mattress, or perhaps existing sheets and other bedding components, for use in accord with the teachings and principles of this invention.

Figure 2:
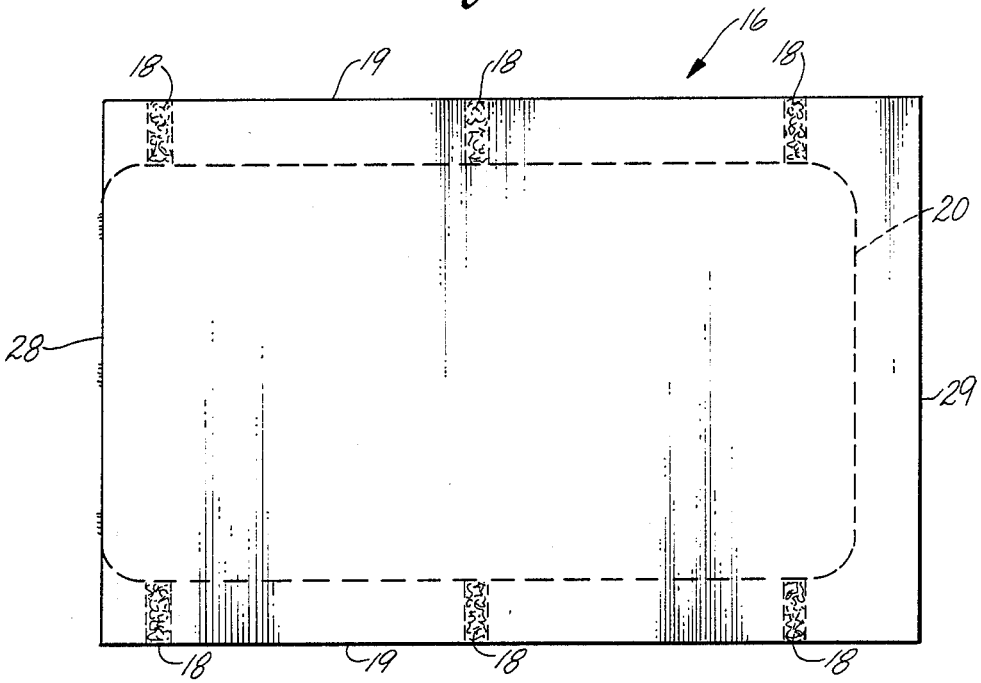
FIG. 2 is a bottom plan view of a lower sheet showing mattress attachment points of the embodiment shown in FIG. 1.

Referring now to FIG. 2, a bottom sheet 16 of the bedding system preferably comprises a flat rectangular bottom sheet to which pieces of loop material 18 defined for cooperation with hook material, are attached at spaced locations along each of its long edges 19 on the reverse side of the sheet 16. The attachment of the several pieces of loop material 18 to bottom sheet 16 preferably is by sewing, but can be accomplished by bonding provided the adhesive or other bonding agent used is effective to maintain the attachment throughout repeated launderings of the sheet. Loop material pieces 18 preferably are the same size and shape as hook material pieces 12. The distance between long edges 19 of the bottom sheet 16 is a selected amount greater than the distance across a major surface 21 of the mattress such that the long edges 19 fall over the long sides 13 of the mattress 10. The distance between the foot edge 28 and the head edge 29 of the bottom sheet 16 is a selected amount greater than the distance along a major surface 21 of the mattress such that the head edge 29 falls over the head end 32 of the mattress 10. The location and pattern of distribution of the pieces of loop material 18 along the long edges of the bottom sheet 16 form a third predetermined pattern which corresponds to the location and pattern of distribution of the pieces hook material 12 along the long sides of the mattress 10. The center of each third pattern along each long edge 19 of the bottom sheet is spaced from the foot edge 28 of the sheet a distance substantially equal to one-half the distance between the mattress 10 end surfaces 30 and 32. The relative location 20 of the mattress, when the bottom sheet is in position to be attached to the mattress 10, is also shown in FIG. 2. The midlength of the third pattern is spaced from foot end 28 of the bottom sheet 16 a distance which is substantially equal to half the length of mattress 10.

Figure 3:
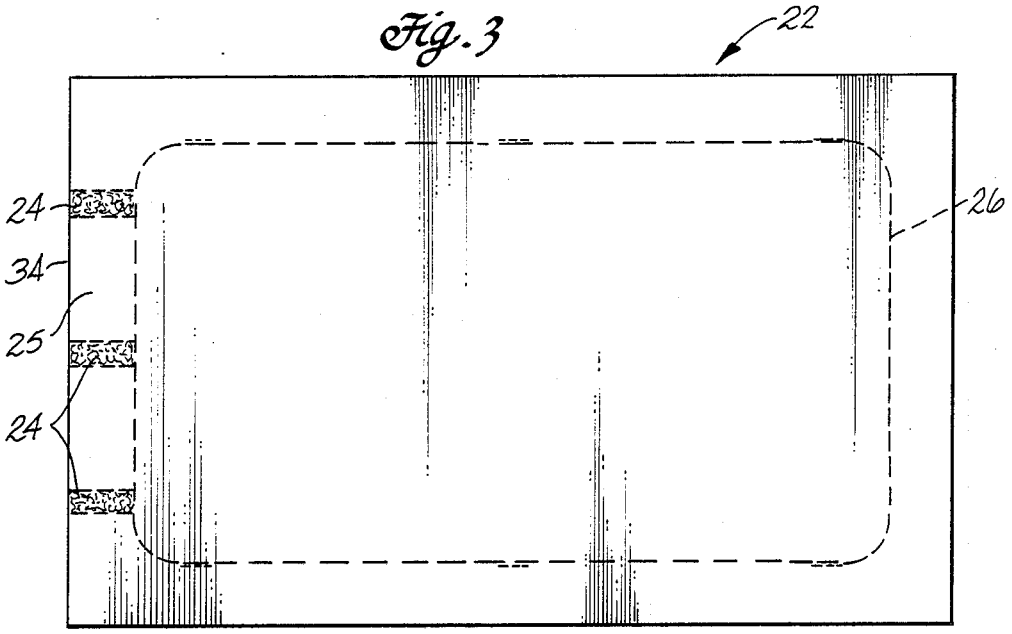
FIG. 3 is a top plan view of an upper sheet showing mattress attachment points of the embodiment shown in FIG. 1.

Referring now to FIG. 3, a top sheet 22 of the bedding system preferably is also a standard rectangular sheet to which pieces of loop material 24 are attached along its foot end 25. The manner of attachment of loop material pieces 24 to the obverse side of the top sheet can be the same as that used to connect pieces 18 to bottom sheet 16, i.e., preferably sewn, but bonding is also possible. Also pieces 24 and 14 preferably are the same size and shape. The location and pattern of distribution of the pieces of loop material 24 along the foot end 25 of the top sheet 22 corresponds to the location and pattern of distribution of the pieces hook material 14 along the ends of the mattress 10. The relative location 26 of the mattress 10, when the top sheet is in position to be attached to the mattress 10, is shown as well in FIG. 3.

The first and second patterns of hook material on the mattress 10 are matched on both sides and at both ends so that, from time to time as is recommended by mattress manufacturers, the mattress 10 can be turned side-for-side, turned end-for-end or turned top-to-bottom without interfering with how the top sheet 22 and the bottom sheet 16 cooperate with the mattress 10.

To make a bed using the bedding system of the invention, the bottom sheet 16 is placed on the mattress 10, reverse side down, with the foot-end of the bottom sheet 28 aligned with the bottom-end of the mattress 30. This means that a portion 2( of the bottom sheet falls over the head-end 32 of the mattress 10. The pieces of loop material 18 on the reverse of the properly placed bottom sheet are then patted into engagement with the hook material 12 along the sides of the mattress 10. At this point, the pieces of hook material 14 at the foot-end 30 of the mattress remain exposed. The top sheet 22 is then placed, with its obverse surface down, on the bottom sheet 16 with the foot-end 34 of the top sheet 22 overhanging the foot end 30 of the mattress 10. The pieces of loop material 24 attached to foot-end 34 of the top sheet 22 are then patted into engagement with the exposed pieces hook material 14 on the foot end 30 of the mattress 10. The head end of the top sheet can then be folded down a desired distance as is common.

The invention makes it possible to make a bed using the above-described mattress and sheet securing arrangement in about half the time needed with normal flat or fitted sheets. Because it is not necessary to lift the mattress to attach the sheets, the invention avoids considerable back strain to the person making the bed; this benefit is of great interest to hotels, hospitals and other institutions who employ persons whose principal duties include changing and making a number of beds each day. Because neither the top nor bottom sheet is secured to the mattress by its being tucked under the sides of the mattress, the cost of manufacture of the sheets can be reduced by making them narrower or shorter or both than conventional sheets. This means that sheets made for use in this invention can use less fabric than conventional sheets, be made efficiently, and can cost less than conventional sheets. This is a further benefit to hctels and other institutions which maintain large inventories of bedding materials and which pay by weight for the laundering of bedding materials. As provided by the invention, they need be only long enough to cover the sides of the mattress rather than long enough to be tucked under the sides of the mattress.

Figure 4:
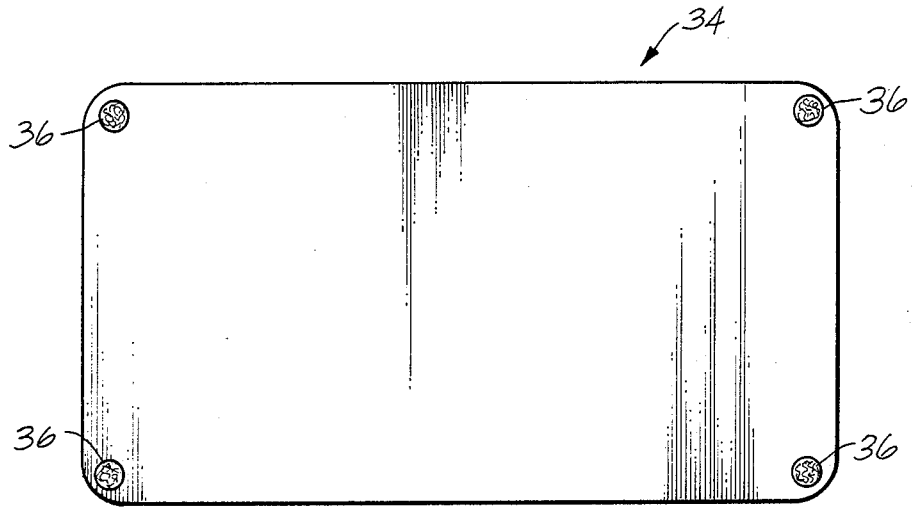
FIG. 4 is a bottom plan view of a mattress pad showing mattress attachment points of an additional aspect of the presently preferred embodiment of the invention;/
Figure 5:
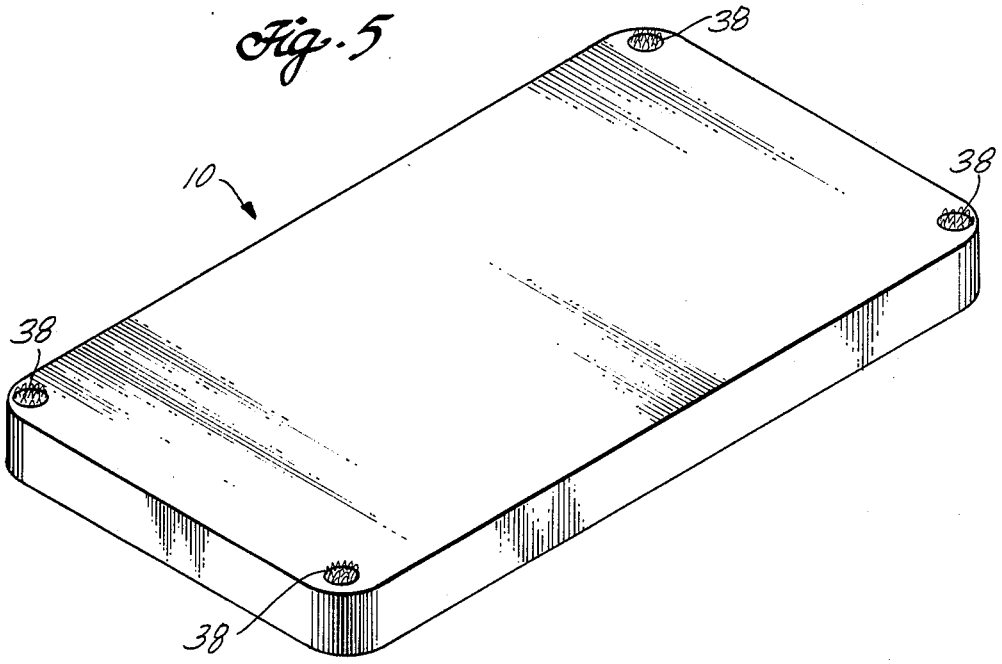
FIG. 5 is a perspective view of a mattress showing mattress pad attachment points of the aspect of the invention shown in FIG. 4.

An additional aspect of the invention includes a mattress pad 34 as shown in FIG. 4. The mattress pad commonly is a rectangular sheet of fabric having obverse and reverse surfaces and of a size sufficient to cover the top surface of the mattress. Pieces of loop material 36 are secured to the reverse surface of the mattress pad proximate to each of its corners. The mattress 10 has pieces of hook material 38 secured on its two major surfaces proximate the corners of these surfaces as shown in FIG. 5. The mattress pad 34 is engaged with the mattress by its being placed on the mattress such that it is certered on the mattress with the loop material 36 on the corners of the mattress pad facing and aligned with the hook material 38 on the corners of the mattress. The loop material on the mattress pad is then patted against the hook material on the mattress securing the mattress pad 34 to the mattress 10. Hook material 38 preferably is placed at the corners of both major surfaces of the mattress so the mattress can be turned over periodically without interfering with the cooperation of a mattress pad with the mattress in the manner described above.

Figure 8:
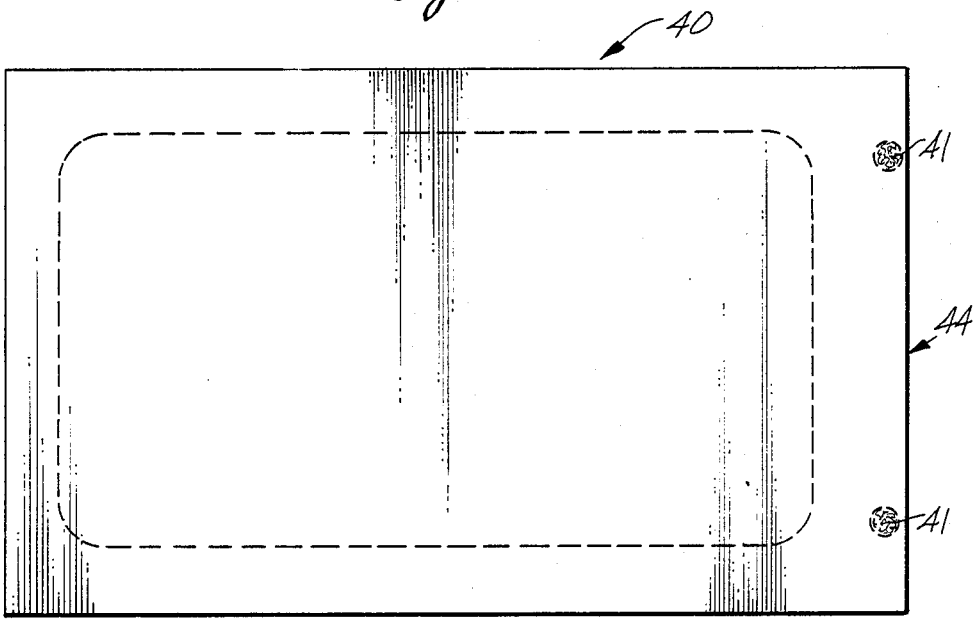
FIG. 8 is a plan view of a blanket which is another aspect of the presently preferred embodiment of the invention, a preferred position of a mattress being shown in broken lines in relation to the blanket.

Another aspect of the invention includes a blanket 40, shown in FIG. 8, to which preferably two pieces of loop material 41 are attached. The pieces of loop material 41 are secured, as by being sewn to the blanket, to the reverse surface of the blanket, proximate to each of the corners at the foot end of the blanket, in a pattern related to the pattern of the pieces of hook material 38 proximate to each end of a major surface of the mattress 10. The blanket 40 is engagable with the mattress 10 by its placement on the top sheet 22 and by tucking cf about three inches of the foot end 44 of the blanket 40 under the foot end 30 mattress 10 such that the loop material 41 of the blanket 40 are facing towards and engaged with the hook material 38 on the major underside surface of the mattress facing away from the top sheet 22. The blanket does not require extensive tucking of a substantial portion of its length under the mattress. Again, less effort and strain by the person making the bed is required. Also, the blanket can be twelve to fifteen inches shorter than a conventional blanket for the pertinent size of mattress.

The hook material pieces which are used for coupling blanket 40 to the mattress are those hook material pieces which are carried by the mattress for cooperation, in any position of the mattress, with mattress pad 34. If, as is recommended by mattress manufacturers, the mattress is turned end for end, or turned over, or both, the mattress still presents areas of hook material by which the mattress pad and the blanket can be coupled to the mattress by use of the loop material pieces carried by the pad and the blanket.

Figure 6:
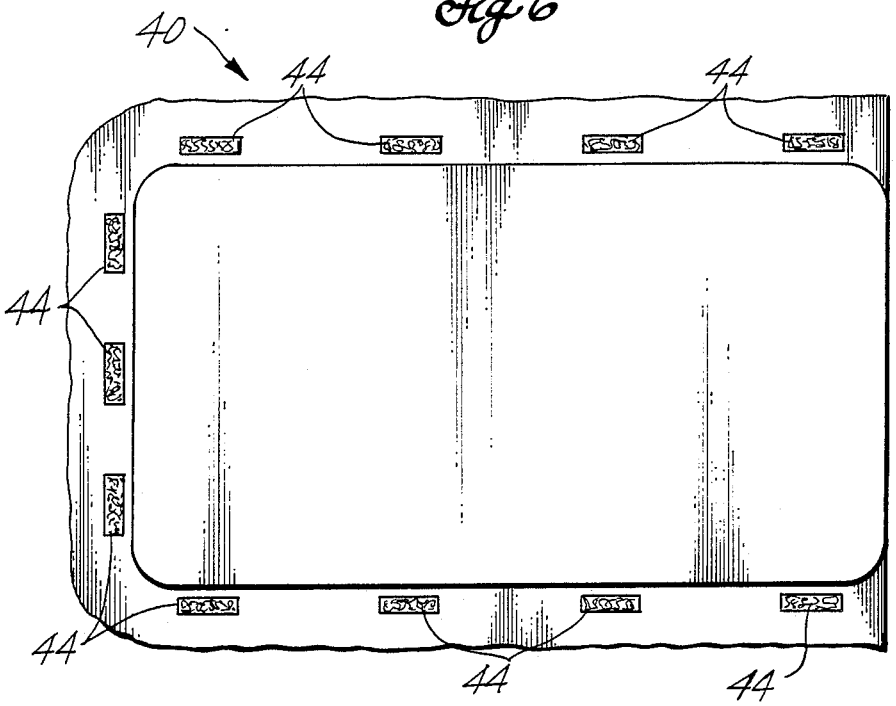
FIG. 6 is a bottom plan view of a dust ruffle shown in a flattened position revealing box spring attachment points of the another aspect of the preferred embodiment of the invention.
Figure 7:
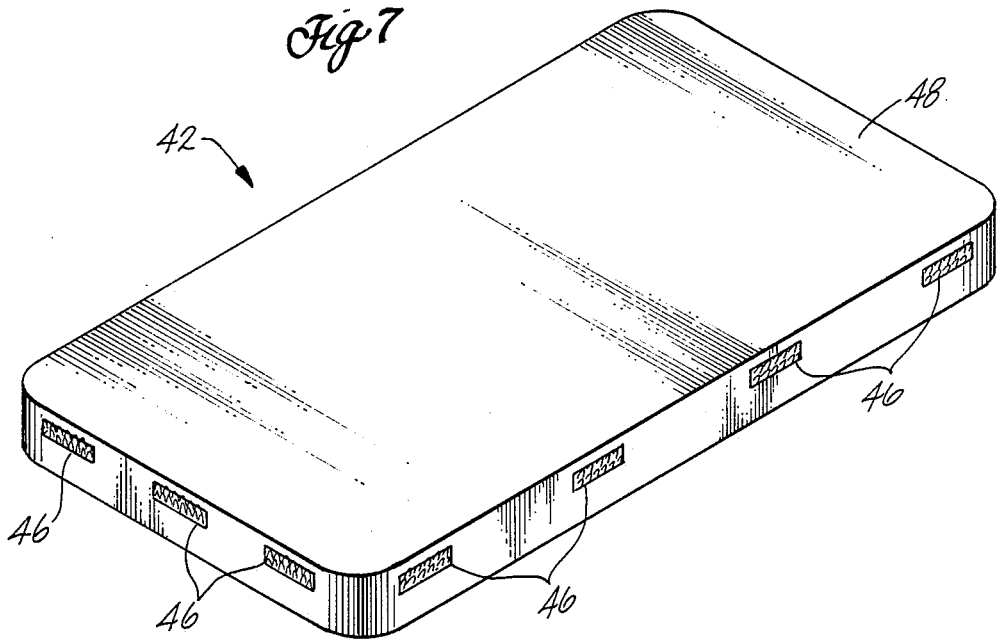
FIG. 7 is a perspective view of a box spring showing dust ruffle attachment points of the aspect of the invention shown in FIG. 6.

FIGS. 6 and 7 show still another aspect of the invention which is a dust ruffle 40 for attachment to a box spring 42. A plurality of pieces of hook material 46 are secured to the box spring side and foot end surfaces adjacent the upper major surface 48 of the mattress. The dust ruffle 40 is a ribbon of fabric of a length approximately equal to the combined length of the side and end surfaces of the box spring 42. The dust ruffle has a plurality of pieces of loop material 44 secured to its inner side and disposed in a pattern which corresponds to the pattern of hook material on the side and end surfaces of the box spring. The dust ruffle 40 is engaged with the box spring 42 by its being placed on the sides and ends of the box spring such that its loop material 44 is aligned with the hook material 46 on the box spring. The loop material 44 on the dust ruffle is then patted against the hook material 46 on the box spring securing the dust ruffle to the box spring.

The invention provides for five sperate pieces of bedding mounted to a mattress and a box spring. Each piece of bedding becomes simpler and quicker to place on a bed, as a result of this invention. Additionally, the material and construction costs of the bottom sheet, blanket and dust ruffle are reduced.

Dust ruffles are typically made with a central fabric area which overlies the box spring, underneath the mattress. The ornamental portion of the dust ruffle, attached to the center fabric piece, extends outward and downward covering the box spring. In the presently preferred embodiment of the invention, the dust ruffle is manufactured without the center fabric piece. The ruffle is a strip-like construction. It has no central area arranged to overlie a box spring. It can therefore be made to an indefinite length, cut and finished with addition of the loop and hook fastener moieties. Because it has no center fabric piece, the dust ruffle can be put on and taken off the box spring without removing the mattress, thus avoiding the back strain normally associated with this operation. The dust ruffle has less bulk and weight without the center piece, thus reducing storage and transportation costs associated with the marketing and distribution of the ruffle and making it easier to clean or launder.

A user of such bedding components can select which ones of the several components of the overall system provided by this invention he or she wishes to use, and can readily equip an existing mattress with suitable fastener moieties for cooperation with the desired bedding components.

In a similar way, a bed dust ruffle according to this invention can be marketed with user-installable releasable fastener moieties cooperable with related moieties preinstalled on the ruffle by a maker of the ruffle. The user can then readily equip an existing box spring or other mattress support for connection of the ruffle to it in the manner described above.

It is contemplated and intended that the patterns of fastener moiety placement on the sides and ends of mattresses in practice of this invention can become standardized for various sizes of mattresses (e.g., twin, regular, king size, and the like) so that bedding components, such as top and bottom sheets, according to this invention can be marketed in a form which a user can apply directly to a mattress.

Further, the benefits of this invention, such as ease of bed making, can be achieved with existing mattresses and bedding components by connecting cooperating releasable fastener moieties, such as pieces of VELCRO hook and loop material, to such existing components.

This in also includes the provision of a kit of pieces of VELCRO or similar hook material of suitable size which can be applied to an existing mattress to adapt the mattress for cooperation with top and bottom sheets, a mattress pad and a blanket defined in accordance with the preceding descriptions. The kit can include a container of a suitable glue useful for adhering the hook material pieces to the desired mattress surfaces at the proper places. It is also within the scope of this invention that the several pieces of hook material can have a pressure-sensitive self-adhesive material on their reverse surfaces in association with peel-away protective release liners in a manner which is well known. In such instance, the adhesive used can be formulated to bond sufficiently securely to the fabric of a mattress to keep the corresponding piece of hook material in place on the mattress throughout repeated cycles of application, use bottom sheet, mattress cover, or blanket) with which such hook material cooperates as applied to the mattress.

Also, bedding components according to this invention, having releasable fastener moieties such as VELCRO loop material applied to them by a manufacturer, can be marketed with sufficient cooperating fastener moieties, such as VELCRO hook material pieces, equipped with suitable mechanisms (such as self-adhesive features) for applying the same to an existing mattress. The pieces of loop material can be sewn to the sheets, mattress pad, blanket or dust ruffle, or they can be bonded in place by use of a pressure sensitive adhesive as described above or by use of a heat activated adhesive and a warm or hot iron. If desired, the sheet or blanket so adapted to this invention by application of suitable fastener moieties can then be cut to the smaller sizes of the corresponding bedding components described above and shown in the accompanying drawings.

Figure 9:
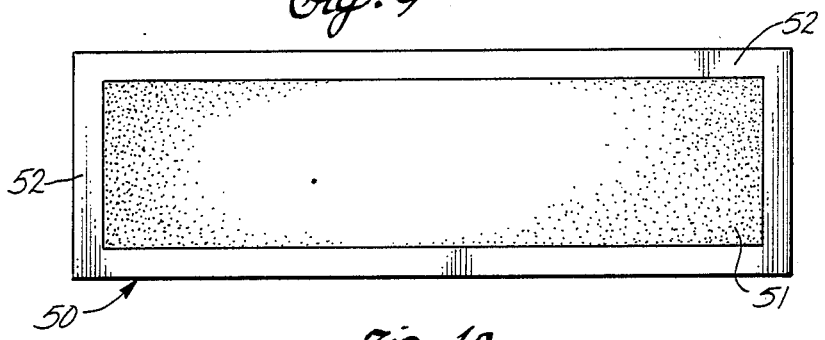
FIG. 9 is a plan view of a first form of hook material piece useful in the practice of this invention in which the hook material can be incorporated into a mattress during manufacture of the mattress.

FIG. 9 shows a hook material piece 50 which can be used in manufacturing a mattress for use with bedding components in the practice of this invention. A central area 51 of hook elements has a backing which defines a margin 52 circumferentially of area 51 and via which piece 50 can be sewn to a suitable piece of mattress encasing fabric.

Figure 10:
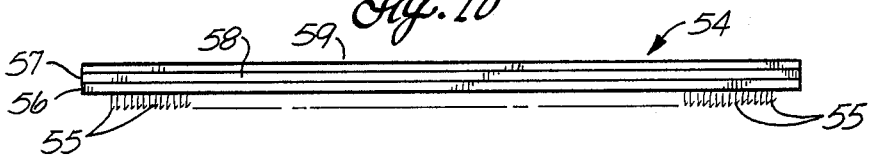
FIG. 10 is a side elevation view of a second form of hook material piece useful in equipping an existing mattress for use according to this invention.

FIG. 10 shows a hook material piece 54 which can be used in adapting an existing mattress for cooperation with bedding components according to this invention as described above. Numerous individual hook elements 55 are carried on a front face of a backing 56 which has a layer 57 of pressure sensitive adhesive disposed over a backing rear face 58; the adhesive layer is covered by a peel-away protective release liner 59. The adhesive defining layer 57 can be formulated to sufficiently wet a mattress encasing fabric upon contact of the adhesive with the fabric that piece 54 becoms securely connected to the fabric upon drying of the adhesive in a manner and time determined by the adhesive formulation.

Figure 11:
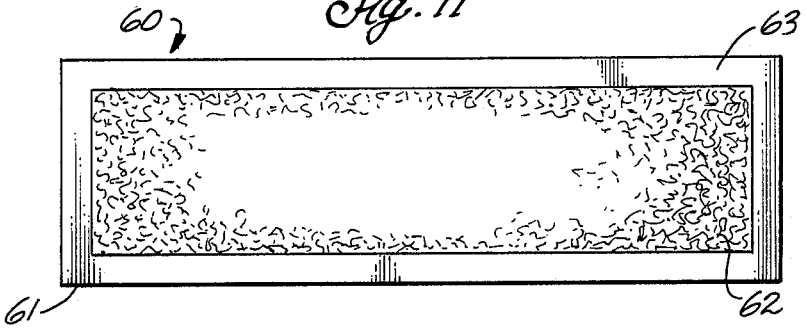
FIG. 11 is a plan view of a first form of loop material useful in the practice of this invention.

FIG. 11 shows a sew-on piece 60 of loop material in which the backing 61 for a central area 62 of loop material forms a circumferential margin 63 via which piece 60 can be sewed by a manufacturer or a user to the fabric of a sheet, blanket, mattress pad or dust ruffle.

Figure 12:
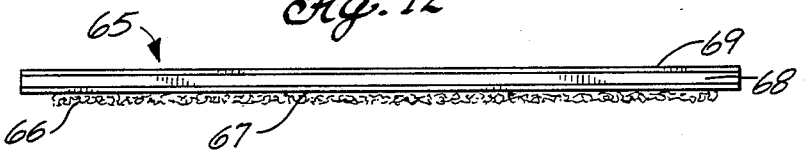
FIG. 12 is a side elevation view of a second kind of loop material piece.

FIG. 12 shows a loop material piece 65 in which numerous loops 66 of suitable filament are carried by and project from a front face of abacking layer 67. A rear face of the backing layer is covered by a layer of suitably formulated pressure sensitive adhesive 68 which is covered, in turn, by a release liner 69. Adhesive 68 can be formulated similarly to adhesive 57 so that it bonds the loop material to a top or bottom sheet, e.g., sufficiently securely that the sheet can be laundered many times without detachment of the loop material from the sheet.

Figure 13:
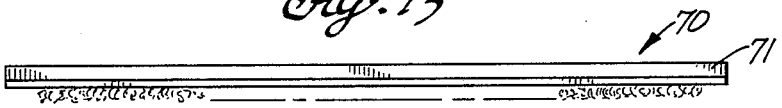
FIG. 13 is a side elevation view of a third kind of material loop piece.

FIG. 13 shows another loop material piece 70 which is similar to loop material piece 65 except as to the nature of the adhesive carried on the rear face of its backing layer. Piece 70 includes an adhesive layer 71 which, as present on the backing layer before use of the piece, is a relatively hard adhesive formulated as a heat activatable adhesive. In use the adhesive can be laid against a bedding component according to this invention (e.g., a top sheet or a bottom sheet) at a desired location on the component and heat can be applied to the adhesive layer, preferably from the other side of the bedding component, as by use of a warm or hot iron. The application of heat to adhesive layer 71 causes it to become plastic and flowable sufficiently to securely adhere to and essentially permanently bond to the bedding component after heat is removed and the adhesive is cooled. Such a heat-bonded loop material piece can remain bonded to the bedding component to which it is applied through repeated launderings of the component.

Hook material piece 54 and loop material pieces 65 and 70 can be used to advantage by manufacturers of mattresses and bedding components according to this invention. Also, they can be used advantageously by persons who desire to adapt existing mattresses, or bedding components, or both for use as parts of the bedding system provided by this invention. It is thus seen that this invention provides a bedding system which encompasses mattresses and bedding components newly manufactured to incorporate the structural features characteristic of it, existing mattresses and bedding components adapted after original manufacture to possess such characteristics, and any desired combination of newly manufactured and existing mattresses and bedding components.

In the preceding description, the term "bedding components" includes any or all of the following articles of manufacture: top sheets, bottom sheets, mattress pads, blankets, and dust ruffles.

It will be apparent from the foregoing that this invention provides a bedding system which enables any combination of bedding components to be coupled to a mattress or to a mattress support with virtually no movement of the mattress. Access to the underside of a mattress is required only in the instance of coupling the blanket to the mattress, and such access is readily obtained with minimal physical effort and no meaningful lifting or movement of the mattress. The only time the mattress needs to be moved or lifted is at one of those infrequent times when the mattress user or owner wishes to turn the mattress end for end, or top for bottom, or both, on its support. It will also be apparent that this invention provides improvements in bedding systems which enable beds to be made effectively and quickly. Other advantages and benefits provided by the invention have been noted in the foregoing descriptions.

In view of the foregoing descriptions of the invention in accordance with applicable requirements for disclosure of inventions under applicable patent statutes, those skilled in &he relevant arts will have no difficulties making changes and modifications in the different described elements of the invention in order to meet their specific requirements or conditions. For example, other types of releasible fastening modalities may be used in place of hook and loop material such as snap fastener arrangements, hook and eye fastener arrangements, and the like. Other patterns of attachment points may be used to secure the sheets, blanket, mattress pad or dust. ruffle to the mattress and box spring. Further, the dust ruffle may be attached to a mattress support other than a box spring. Such changes and modifications may be made without departing from the scope and spirit of the invention as set forth in the following claims.

What is claimed is:

1. A bedding system comprising:

a mattress having opposite major surfaces bounded by end and side mattress surfaces normal to the major surfaces, a top sheet and a bottom sheet; the top and bottom sheets each being releasibly connectable to the mattress via the agency of cooperating respective first and second moieties of a selected kind of releasable fastener mechanism respectively carried by the mattress and the sheets;

a plurality of first fastener moieties secured to each of the mattress side and end surfaces substantially between the mattress major surfaces, the first fastener moieties secured to the mattress side surface being disposed in essentially identical first predetermined patterns symmetrical about the midlength of each side surface, the first fastener moieties secured to the end surfaces being disposed in essentially identical second predetermined second patterns symmetrical about the midlength of each end surface, whereby the patterns are essentially the same relative to an actual mattress top surface and a mattress foot end surface regardless of which major surface is the top surface and which end surface is the foot end surface;

the bottom sheet having obverse and reverse surfaces, opposite side edges, and opposite head and foot end edges, the distance between the side edges being a selected amount greater than the distance across the major surface of the mattress between its side surfaces, the distance between the end edges of the bottom sheet at least as great as the distance across the major surface of the mattress between its end surfaces, the bottom sheet including a plurality of second fastener moieties secured to the bottom sheet reverse surface proximate the side edges and disposed in each instance in a third predetermined pattern corresponding to the first predetermined pattern of first fastener moieties on the side surfaces of the mattress, the center of each third pattern along each side edge of the bottom sheet being spaced from the foot edge of that sheet a distance substantially equal to one-half the distance between the mattress end surfaces; and the top sheet having obverse and reverse surfaces, opposite side edges, and opposite head and foot end edges, the top sheet including a plurality of second fastener moieties secured to the top sheet obverse surface only proximate to the foot edge and disposed in a fourth predetermined pattern corresponding to the second predetermined pattern of first fastener moieties on the end surfaces of the mattress, the center of the fourth pattern being disposed substantially at the midlength of the distance between the top sheet side edges.

2. The bedding system of claim 1 wherein the top and bottom sheets are simple rectangular pieces of fabric.

3. The bedding system of claim 1 wherein the first fastener moieties are pieces of hook material and the second fastener moieties are pieces of cooperating loop material.

4. The bedding system of claim 1 further comprising:

a mattress pad releasibly connectable to the mattress via the agency of cooperating respective first and second moieties of a selected kind of releasable fastener mechanism carried by the mattress pad and the mattress;

second fastener moieties secured to a surface of the pad proximate to each corner thereof and disposed in a fifth predetermined pat&:ern; and the mattress having first fastener moieties secured on its two major surfaces proximate the corners of these surfaces in a sixth predetermined pattern corresponding to the fifth predetermined pattern of the second fastener moieties on the mattress pad.

5. The bedding system of claim 4 further comprising:

a blanket, having opposite head and foot end edges; and second fastener moieties secured to a surface of the blanket proximate to each foot edge corner thereof in a seventh predetermined pattern related to the sixth predetermined pattern of the first fastener moieties on the mattress majcr surfaces.

6. The bedding system of claim 5 wherein the first fastener moieties are pieces of hook material and the second fastener moieties are pieces of cooperating loop material.

7. The bedding system of claim 1 further comprising:

a dust ruffle and a box spring, the ruffle being releasibly connectable to the box spring via the agency of cooperating respective first and second moieties of a selected kind of releasable fastener mechanism respectively carried by the dust ruffle and the box spring;

the box spring having side and end surfaces and a plurality of first fastener moieties secured to its side and end surfaces in a further predetermined pattern adjacent an upper surface thereof; and the dust ruffle being of strip-like nature and having an effective length approximately equal to the combined length of the side and one of the end surfaces of the box spring, the ruffle having inner and outer sides including a plurality of second fastener moieties secured to its inner side according to the further predetermined pattern.

8. The bedding system of claim 7 wherein the first fastener moieties are pieces of hook material and the second fastener moieties are pieces of cooperating loop material.

9. A bed sheet set comprising:

a bottom sheet having obverse and reverse surfaces, opposite side edges, and opposite foot and head end edges, the distance between the side edges being about equal to the width and twice the thickness of a mattress of selected size with which the bottom sheet is sized to cooperate in use of the sheet, the distance between the sheet foot and head end edges being at least as great as the length of the mattress of selected size, the bottom sheet carrying on the reverse surface thereof along each side edge thereof a plurality of first fastener moieties which are cooperable with related second fastener moieties to define a selected kind of releasable fastener mechanism, the first fastener moieties along each bottom sheet side edge being disposed within a portion of the length of the bottom sheet which begins at the foot edge thereof and extends therealong a distance substantially equal to the length of a mattress of said selected size and being disposed in a first selected pattern which is symmetrical about the midlength of said sheet length portion, the said first patterns along the bottom sheet side edges being essentially identical in terms of the number and spacing of said first fastener moieties therein;

a top sheet having obverse and reverse surfaces, opposite side edges, and opposite foot and head end edges, the distances respectively between the side edges and the end edges of the top sheet being selected amounts greater than the corresponding dimensions of a mattress of said selected size, the top on the obverse surface thereof along only the foot edge thereof carrying a plurality of the first fastener moieties, the top sheet first fastener moieties being disposed within a portion of the width of the top sheet which is substantially equal to the width of a mattress of said selected size and which is centered at the middle of the width of the top sheet, the top sheet first fasteners moieties being disposed in a second selected pattern which is symmetrical about the middle of width of the top sheet; and a plurality of second fastener moieties for coupling with the first fastener moieties and equal in number to the sum of the number of first fastener moieties carried by the bottom sheet and twice the number of first fastener moieties carried by the top sheet, the second fastener moieties having associated with them means adapting them for affixation to the side and end surfaces of the mattress, whereby the second fastener moieties can be affixed to the mattress side surfaces and the mattress end surfaces in patterns which are essentially the same relative to an actual mattress top surface and an actual mattress foot end surface regardless of which major surface is the top surface and which end surface is the foot end surface, and wherein the first fastener moieties are pieces of loop material and the second fastener moieties are pieces of cooperating hook material.

10. The bed sheet set of claim 9 wherein the means adapting the second fastener moieties for affixation to a mattress comprises an adhesive.

11. A method for coupling bed sheets to a mattress for the making of a bed comprising the steps of (a) identifying a mattress of selected size having opposite major surfaces bounded by end and side surfaces normal to the major surfaces, (b) providing a tottom sheet having a width between opposite side edges which is at least equal to the sum of the width of the mattress and about twice the thickness of the mattress between its major surfaces and having a length between opposite foot and head end edges which is at least equal to the length of the mattress between its opposite end surfaces, (c) providing a top sheet having a width at least equal to the width of the mattress, a length at least equal to the length of the mattress, and obverse and reverse surfaces, (d) providing a first plurality of first fastener moieties and a second plurality of second fastener moieties defined in cooperation with the first moieties for coaction therewith as respective parts of a releasable fastener of a selected kind, (e) attaching, within a portion of the length of the bottom sheet which begins at the foot edge thereof and extends along the length thereof a distance substantially equal to the length of the mattress, equal first plural numbers of the first fastener moieties to the reverse surface of the bottom sheet along each side edge thereof in essentially identical first patterns which are symmetrical about the mid-length of said bottom sheet length portion, (f) attaching, within a portion of the width of the top sheet which is substantially equal to the width of the mattress and which is centered essentially at the center of the width of the top sheet, a second plural number of the first fastener moieties to the obverse surface of the top sheet along only the foot edge thereof in a second pattern which is symmetrical about the center of the width of the top sheet, (g) attaching to each side surface of the mattress a number of the second fastener moieties which is equal to the first number of the first moieties in a third pattern which is symmetrical about the mid-length of the mattress and which is essentially identical to the first pattern, and (h) attaching to each end surface of the mattress a number of the second fastener moieties which is equal to the second number of the first moieties in a fourth pattern which is symmetrical about the middle of the width of the mattress and which is essentially identical to the second pattern, (i) the number of second fastener moieties attached to the mattress side and end surfaces being equal to the sum of the number of first fastener moieties attached to the bottom sheet and twice the number of first fastener moieties attached to the top sheet.

12. The method of claim 11 wherein the first fastener moieties are pieces of loop material and the second fastener moieties are pieces of cooperating hook material.

* * * * *

UNITED STATES PATENT AND TRADEMARK OFFICE

CERTIFICATE OF CORRECTION

PATENT NO. : 4,979,251

DATED : December 25, 1990

INVENTOR(S) : Norma Lazar

It is certified that error appears in the above-identified patent and that said Letters Patent is hereby corrected as shown below:

Title page, item [56] References Cited

References, line 2, change "10/1992" to -- 10/1902 --.
References, line 12, change "Golreath" to -- Gilreath --.

Column 1, line 46, change "fasteneing" to -- fastening --.

Column 2, line 9, change "ccoperating" to -- cooperating --.

Column 3, line 42, before "drawings" insert -- accompanying --.
Column 3, line 54, after "invention;" delete "/".

Column 4, line 13, change "material loop" to -- loop material --.
Column 4, line 30, after "FIG." insert -- 1 --.
Column 4, line 53, change "thcugh" to -- though --.
Column 4, line 60, change "Hock" to -- Hook --.

Column 5, line 66, change "2(" to -- 29 --.

Column 6, line 29, change "hctels" to -- hotels --.
Column 6, line 47, change "certered" to -- centered --.
Column 6, line 67, after "tucking" change "cf" to -- of --.

Column 8, line 23, change "in" to -- invention --.
Column 8, line 39, after "use" insert -- and removal of the related bedding component top sheet, --.

UNITED STATES PATENT AND TRADEMARK OFFICE

CERTIFICATE OF CORRECTION

PATENT NO. : 4,979,251

DATED : December 25, 1990

INVENTOR(S) : Norma Lazar

It is certified that error appears in the above-identified patent and that said Letters Patent is hereby corrected as shown below:

Column 9, line 9, change "becoms" to -- becomes --.
Column 9, line 19, change "abacking" to -- a backing --.

Column 10, line 19, change "&he" to -- the --.
Column 10, line 28, after "dust" delete the period.

In the Claims

Column 11, line 35, change "pat&:ern" to -- pattern --.
Column 11, line 48, change "mjcr" to -- major --.

Column 13, line 9, change "tottom" to -- bottom --.

Signed and Sealed this

Fourteenth Day of July, 1992

*Attest:*

DOUGLAS B. COMER

*Attesting Officer*

*Acting Commissioner of Patents and Trademarks*